US010750927B1

(12) United States Patent
Nurre

(10) Patent No.: US 10,750,927 B1
(45) Date of Patent: Aug. 25, 2020

(54) HANDS-FREE SHOE SOLE CLEANING DEVICE AND METHOD

(71) Applicant: William J. Nurre, Ashland, OR (US)

(72) Inventor: William J. Nurre, Ashland, OR (US)

( * ) Notice: Subject to any disclaimer, the term of this patent is extended or adjusted under 35 U.S.C. 154(b) by 203 days.

(21) Appl. No.: 16/134,356

(22) Filed: Sep. 18, 2018

Related U.S. Application Data

(60) Provisional application No. 62/563,468, filed on Sep. 26, 2017.

(51) Int. Cl.
*A47L 23/22* (2006.01)
*B08B 3/02* (2006.01)
*A47L 23/02* (2006.01)

(52) U.S. Cl.
CPC ..... *A47L 23/22* (2013.01); *A47L 23/02* (2013.01); *B08B 3/026* (2013.01)

(58) Field of Classification Search
CPC ..... A47L 23/22
See application file for complete search history.

(56) References Cited

U.S. PATENT DOCUMENTS 5,173,972 A 12/1992 Goodman
5,964,959 A 10/1999 Bleth
6,584,636 B2 7/2003 Schlem
6,662,398 B1 12/2003 Thompson
6,668,842 B1 12/2003 Wilke et al.
6,736,339 B1 5/2004 Mayers
7,500,488 B1 3/2009 Long
7,725,974 B2 6/2010 Hughes
7,877,826 B2 2/2011 Franklin
9,603,504 B2 3/2017 Cruz et al.
9,622,642 B2 4/2017 Braaten et al.
2004/0230144 A1 11/2004 Weinberger
2010/0299828 A1 12/2010 Shapiro

*Primary Examiner* — Jason Y Ko
(74) *Attorney, Agent, or Firm* — Jerry Haynes Law

(57) ABSTRACT

A hands-free footwear sole cleaning device is foot-actuated to clean the bottom of footwear sole. Applying direct force with the footwear sole actuates a sprayer to discharge a cleaning fluid directly into the crevices and traction that form in the bottom of the footwear sole; and thereby remove debris. The sprayer is adjustable so that the direction, intensity, and pattern of the cleaning fluid can be adjusted for different cleaning needs and footwear soles. The device comprises an elevated base that provides support and, through its elevated disposition enables drainage of the cleaning fluid and debris. The device also includes a sprayer that is detachably retained in the elevated base to forcibly discharge cleaning fluid towards the footwear sole. The device also includes a foot trigger that is pivotally in communication with a spray trigger on the sprayer to actuate discharge of cleaning fluid onto the footwear sole with minimal splashing and debris dislodgement above the elevated base.

16 Claims, 9 Drawing Sheets

HANDS-FREE SHOE SOLE CLEANING DEVICE AND METHOD

CROSS-REFERENCE TO RELATED APPLICATIONS

This application claims priority from U.S. Provisional Application Ser. No. 62/563,468, entitled "Hands-Free Shoe Sole Cleaning Device and Method", filed on Sep. 26, 2017, which application is hereby incorporated herein by reference in its entirety.

FIELD OF THE INVENTION

The present invention relates generally to a footwear sole cleaning device and method. More so, the present invention relates to a hands-free and portable footwear sole cleaning device comprising a detachably attached sprayer for enhanced cleaning of the bottom of the footwear sole, self-cleaning the device, cleaning the surrounding area or the sides of the footwear and its method of operation.

BACKGROUND OF THE INVENTION

Those skilled in the art will recognize that shoes and other footwear are exposed to various contaminants including, sand, dirt, mud, fecal matter, construction waste, garbage, or other noxious substances. Perhaps the most odious example is animal excrement, such as dog feces, or cow dung, but mere dirt and earth often cakes and collects on the bottom of footwear, such as the boots of a person working in a garden or the shoes of a person walking on a muddy trail. These contaminants are tracked into buildings when a person wearing soiled shoe enters them. It is unacceptable to have large "globs" of soil, particularly excrement, accumulate on the doormat, for example, where it may be tracked through the entryway and into the buildings by subsequent users; cleaning doormats, in turn, is a notoriously difficult and unpleasant task.

Using a conventional water hose to clean a shoe sole is not practical because it typically dampens the shoe upper and splashes water and contaminants onto the user. Numerous shoe and foot cleaning devices include means for producing a wide or panoramic spray pattern, which would wet both the shoe and the wearer. Other types of such apparatus employ rotating brushes powered from an electrical power source or stationary brushes.

Shoe cleaning devices using liquids such as water offer several design challenges. Fundamentally, the device must contain and control the water sprays so they strike and clean the desired portions e.g., bottom and sides of the shoe without wetting the user's leg and other portions e.g., top of the shoe while using as little water as possible.

Numerous attempts have been made and several prior art devices are known for cleaning a footwear or more specifically a footwear sole. Even though these innovations may be suitable for the specific purposes to which they address, however, they would not be as suitable for the purposes of the present invention.

For example, U.S. Pat. No. 5,173,972 to Goodman discloses an automatic foot washer comprising a pressurized water source and a flexible valve hose, a grated actuating platform and an actuator lever that is operatively contacts the flexible valve hose to, when a person steps on the actuator platform, open the valve assembly and establish communication of the pressurized water source and the plurality of spray outlets to spray water through the plurality of spray holes over the grated actuating platform and onto a person's feet, ankles, and calves.

U.S. Pat. No. 5,964,959 to Bleth teaches a shoe cleaning device using liquid sprays and including a housing having a U-shaped opening. Crisscrossing, upwardly directed sprays then strike and clean the shoe bottom while downwardly directed side sprays clean the shoe sides. Any portions of the upwardly directed, crisscrossing sprays not striking the user's shoe are captured in the opposing side portions of the U-shaped opening and directed into the base portion.

U.S. Pat. No. 6,584,636 to Schlem describes a footwear cleaning apparatus that includes an upper frame for supporting the user to stand upright while cleaning footwear being placed over a foot platform on a lower frame. A hose directs water upwardly onto the footwear sole. The apparatus further comprises two side brushes, a scraper assembly for cleaning the sole and sides of the footwear.

U.S. Pat. No. 6,662,398 to Thompson discloses a hands free foot scrubber comprising a raised foot pad area having bristles on an upper surface and an enclosed refillable bladder containing liquid soap fitting within the under surface below the foot pad. Foot pressure causes soap to be released on to the foot pad to facilitate hands free feet cleaning. The mat includes water drain holes and suction cups on the bottom of the mat and bladder which hold the components in place.

U.S. Pat. No. 6,668,842 to Wilke et al. describes a method and apparatus for dispensing a fluid of mixed disinfectant and water in a spray to footwear of a worker, the apparatus comprises a housing including a base section, a platform attached to the base section, a fluid dispensing assembly coupled to the housing, and a fluid dispensing system of mixed disinfectant and water when a force is applied to the platform so that the spray of the fluid is dispensed onto the footwear.

U.S. Pat. No. 6,736,339 to Mayers teaches a device for cleaning footwear soles including an H-shaped base frame formed of hollow tubes having a vertical water inlet line upwardly extending therefrom at a predetermined angle to deliver multiple pressurized streams of water to effectively clean a user's footwear sole while minimizing splashing of a user or a user's shoe.

U.S. Pat. No. 7,500,488 to Long discloses an apparatus for removing soil from footwear comprising a spray nozzle connected to a plunger having a discharge opening in its upper end, so that stepping on the plunger actuates a flow of water there through. The nozzle includes a return spring that biases the valve back to the closed position when the plunger is released.

U.S. Pat. No. 7,725,974 to Hughes describes a cleaning and disinfecting system for footwear or feet. The system is automatically activated only when a person stands on the device. Optionally, a venturi component allows the addition of a cleaning or disinfecting fluid with the cleaning solution or water, further it comprises an optional brush on a wand provides cleaning to upper foot areas as required.

U.S. Pat. No. 7,877,826 to Franklin teaches a foot washing station comprising a foot platform; a valve connected to a water supply; an actuator operably coupled to the valve; opposing spray members having plurality of nozzles are downwardly directed to knock debris off the lower leg and foot of a user to thus wash the debris away in a hands-free operation.

U.S. Pat. No. 9,603,504 to Cruz et al. discloses a footwear cleaning apparatus that includes a box having an open top surface for receiving a piece of footwear; and a plurality of brushes arrayed within the box, a plurality of nozzles emit a pressurized spray of water at the footwear.

U.S. Pat. No. 9,622,642 to Braaten et al. teaches a device for cleaning of footwear in connection with use of construction site vehicles; the device comprises a water pump, nozzles and water pipe, an air compressor system, housing that receiving the footwear to be cleaned. The device uses a sensor to automatically flush the footwear with water via the water pump and immediately thereafter to blow the footwear dry with air from the compressor.

U.S. Pat. Application No. 2004/0230144 to Weinberger describes a cleaning and/or massage device, comprising suction cups to fix the footwear in a position and a hydraulic drive which can be connected to a multiway valve of a water supply line and drives a brush in a rotating manner.

U.S. Pat. Application No. 2010/0299828 to Shapiro describes a self-contained pressure activated foot washer comprising a basin having a plurality of dispensing heads; a water reservoir, an air compressor; and a pump. Water and air is combined and emitted though said dispensing heads to remove debris from said persons' feet into the bottom of the basin.

It is apparent now that numerous innovations that are adapted to footwear sole cleaning have been developed in the prior art and that they are adequate for various purposes. Furthermore, even though these innovations may be suitable for the specific purposes to which they address, accordingly, they would not be suitable for the purposes of the present invention as heretofore described. Thus a hands-free portable footwear sole cleaning device for enhanced cleaning of the bottom of the footwear sole and method of operation is needed.

SUMMARY OF THE INVENTION

The present invention relates to a footwear sole cleaning device that is actuated, hands-free, to clean the bottom of the footwear sole by pressing down on the device with the footwear sole, so as to discharge a cleaning fluid directly into the crevices and traction that form in the bottom of the footwear sole, and thereby remove debris that lodges inside the crevices and traction; whereby an elevated base enables support for the device and drainage of cleaning fluid; a sprayer is retained in the elevated base to carry cleaning fluid, and is disposed upwardly away from the base and towards the footwear sole; and a foot trigger is in communication with a spray trigger so that depressing the foot trigger with the footwear sole actuates the sprayer to discharge the cleaning fluid towards the bottom of the footwear sole with minimal splashing and debris dislodgement above the elevated base. With it, the user can easily and quickly clean dirt and other debris from the bottoms and sides of his or her footwear in an efficient and effective manner.

According to an aspect of the present invention, a hands-free footwear sole cleaning device is provided, the device includes a base comprising a panel defined by a top surface, a bottom surface, and multiple apertures formed in a spaced apart relationship through the panel, the base further comprising at least one mount member extending from the bottom surface of the panel to elevate the panel above the ground surface to a desired height, the base further comprising a bracket disposed at the top surface; a sprayer comprising an elongated hollow body for carrying a cleaning fluid having an inlet end for receiving the cleaning fluid and a discharge end for discharging the cleaning fluid, the body of the sprayer further comprising a pressure actuated spray trigger operational to actuate discharge of the cleaning fluid through the discharge end when the spray trigger is pressed, the discharge end of the sprayer comprising a spray head, wherein the spray head being detachably attached to the bracket on the top surface of the panel, whereby the intensity of the discharged cleaning fluid is adjustable by the amount of pressure applied by the user on the spray trigger; and a foot trigger hingedly joined to the panel of the elevated base at a hinge, wherein the foot trigger comprising a foot platform and multiple legs, the foot platform comprises a flat surface to help inhibit slippage of the footwear sole of a user, the legs rest on the panel and a slot between two consecutive legs allowing the stepper to be engaged with the body of the sprayer, thereby allowing the foot trigger to engage with the spray trigger while holding the foot trigger in a desired position, whereby pressing the foot trigger by a footwear of a user causes the foot trigger to press the spray trigger for actuating discharge of the cleaning fluid to clean the sole of the footwear.

In view of the foregoing, it is therefore an objective of the present invention to thoroughly clean the crevices and traction on the bottom of the footwear sole with a strong stream of cleaning fluid without using the hands.

Another objective is to spray the bottom of the footwear sole without splashing cleaning fluid or debris upwardly and onto the pant legs or upper extremities of the user.

Yet another objective is to prevent debris from falling into the spray trigger, thereby reducing the possibility of a malfunction of the spray trigger.

Yet another objective is to enable drainage of the cleaning fluid beneath the elevated base by elevating the base.

Yet another objective is to provide a sprayer that discharges cleaning fluid in a targeted manner directly onto the bottom of the footwear sole.

Yet another objective is to inhibit slippage of the footwear sole on the foot trigger through use of a textured foot base.

Yet another objective is to provide an inexpensive to manufacture footwear sole cleaning device.

By self-cleaning in such a manner, numerous advantages are possible. For one, subsequent footwear soles are provided with a clean foot base on which to depress the foot trigger and receive cleaning. Another advantage is provided by detaching the sprayer from the base. By detaching the sprayer to clean the base and the stepper, the sprayer trigger is outside of the wash area where the dirty water is falling. This helps to segregate the cleaning means from the sole engagement means of the device and thus prevents debris from falling into the spray trigger of the sprayer thus reducing the possibility of a malfunction of the spray trigger.

Other objectives and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The invention will now be described, by way of example, with reference to the accompanying drawings, in which:

FIG. 13A shows the stepper being pivotally displaced away from the spray trigger, and FIG. 13B shows the sprayer detached from the base and spraying off the stepper and the elevated base to clean the device, in accordance with an embodiment of the present invention.

Like reference numerals refer to like parts throughout the various views of the drawings.

DETAILED DESCRIPTION OF THE INVENTION

Figure 1:
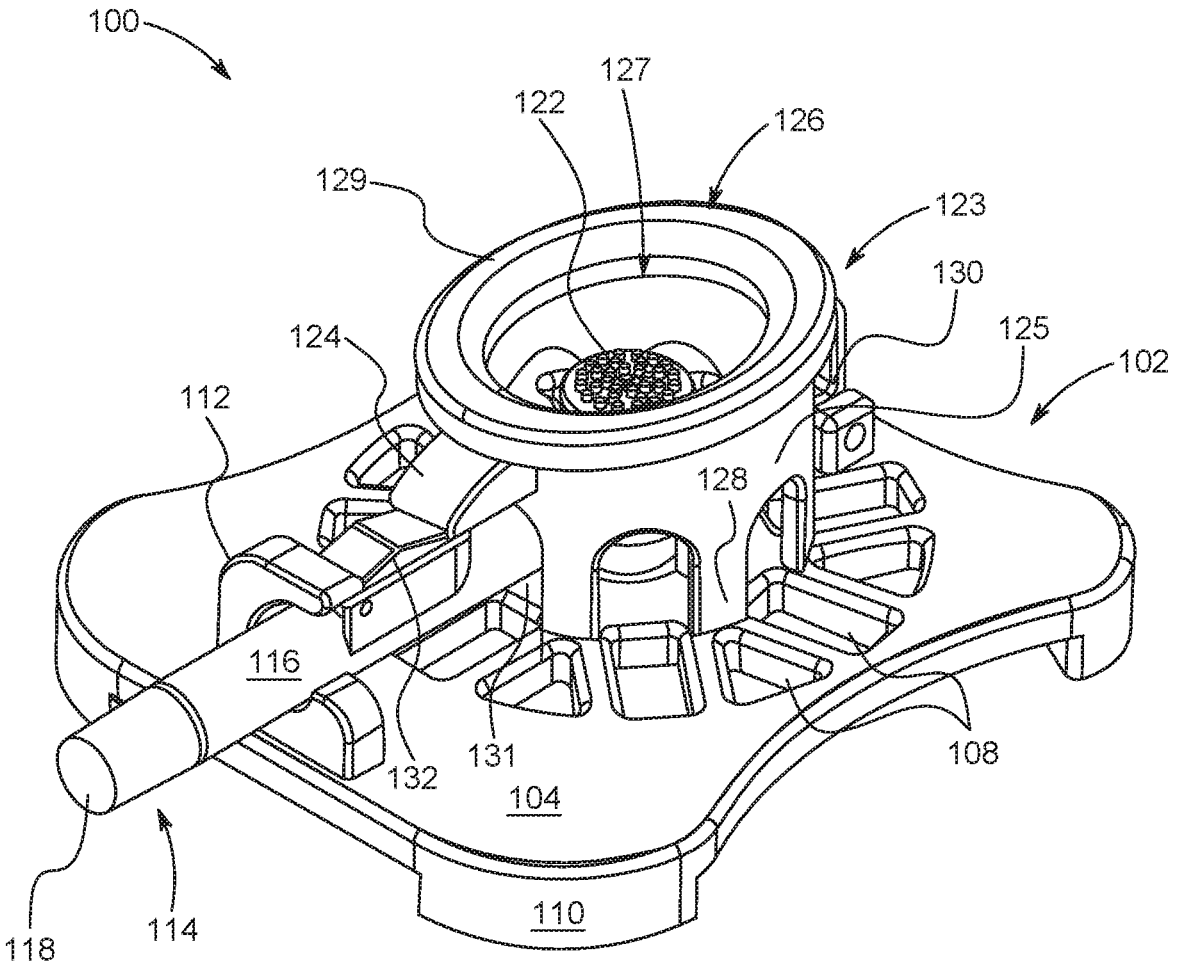
FIG. 1 illustrates a perspective view of an exemplary hands-free footwear sole cleaning device with a foot trigger engaged with a spray trigger, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A hands-free footwear sole cleaning device 100 for enhanced cleaning of bottom of a footwear (e.g. shoe) sole 200, and a method 300 for hands-free cleaning of the footwear sole are referenced in FIGS. 1-14. The hands-free footwear sole cleaning device 100, hereafter "device 100", elevates above a ground surface and is actuated, hands-free, to clean the bottom of the footwear sole 200 through a foot-actuated force. The foot-actuated force engages a foot trigger 124 with a spray trigger 132 to actuate a sprayer 114 to discharge cleaning fluid 202 directly into the crevices and traction that form in the bottom of the footwear sole 200; and thereby remove debris that lodges inside the crevices and traction. The elevated disposition of the device 100 allows the excess cleaning fluid 202 and debris to freely flow away without splashing onto the footwear, the user, or the spray trigger. The intensity of the cleaning fluid 202 can be adjusted to accommodate different cleaning needs and footwear sole types. Furthermore, the device 100 self-cleans, as a spray head 122 detaches from the base 102 to spray debris off a stepper 123 and the base 102 of the device 100 with the cleaning fluid 202.

One aspect of a hands-free footwear sole cleaning device 100 comprises an elevated base 102 comprising multiple apertures 108; a bracket 112 attached to the elevated base 102; a sprayer 114 detachably attached to the bracket 112, wherein the sprayer 114 comprising an elongated hollow body 116 for carrying a cleaning fluid 202 from a source (not shown) through an inlet end 118 to a discharge end 120, the discharge end 120 of the sprayer 114 comprising a spray head 122, the body 116 of the sprayer 114 further comprising a pressure actuated spray trigger 132; and a stepper 123 pivotally joined to the elevated base 102, wherein the stepper 123 comprising a foot platform 126, a cylindrical wall 125, and a foot trigger 124 extending away from the foot platform 126, the foot platform 126 comprises an annular surface that is configured to expose the spray head 122 towards a footwear sole 200 of a user placed on the annular antiskid surface, the cylindrical wall 125 comprises at least one slot to engage with the elongated body 116 of the sprayer 114, thereby allowing the foot trigger 124 to remain in a desired position over the spray trigger 132 external to the cylindrical wall 125 of the stepper 123, whereby applying pressure on the foot trigger 124 by the footwear sole 200 allows the spray trigger 132 to be pressed for actuating discharge of the cleaning fluid 202 through the spray head 122 to provide a hands-free cleaning of the sole of the footwear 200 and to dislodge the discharged cleaning fluid 202 and debris from the footwear sole 200 to flow freely within the cylindrical wall 125 of the stepper 123 and beneath the elevated base 102 through the multiple apertures 108 in the elevated base 102, thereby preventing splashing of the cleaning fluid 202 and the debris.

In another aspect, intensity of the discharged cleaning fluid 202 is adjustable, thereby facilitating targeted cleaning of the bottom of the footwear sole 200.

In another aspect, the annular foot platform 126 comprises a central hollow area 127 configured to expose the spray head 122 towards a footwear sole 200 of a user, the footwear sole 200 is placed on the annular surface 129 of the foot platform 126 allowing the pressurized stream of cleaning fluid 202 from the spray head 122 to thoroughly clean crevices and traction on the bottom of the footwear sole 200 without using the hands.

In another aspect, the bracket 112 is configured to receive the spray head 122 in a snap fit relationship.

In another aspect, the spray trigger 132 is spring biased.

In another aspect, the elevated base 102 has a generally rectangular shape.

In another aspect, the foot platform 126 is toilet seat-shaped.

In another aspect, the elevated base 102 comprising one or more mount members 110 to elevate the base 102 above the ground surface to a desired height.

In another aspect, the sprayer 114 is configured to be detached from the device 100 and operated by pressing the spray trigger 132 thereby facilitating independent use of the sprayer 114.

In yet another aspect, a hands-free footwear sole cleaning device 100 comprises: an elevated base 100, the elevated base 102 comprising a panel 104 defined by a top surface 106, a bottom surface 105 and multiple apertures 108 formed in a spaced apart relationship through the panel 104, the base 102 further comprising at least one mount member extending from the bottom surface 105 of the panel to elevate the panel 104 above the ground surface to a desired height; one or more stoppers 107 are attached to the top surface 106 of the panel 104; a bracket 112 attached to the top surface 106 of the panel 104; a sprayer 114 comprising an elongated hollow body 116 for carrying a cleaning fluid 202 from a source (not shown) through an inlet end 118 to a discharge end 120, the discharge end 120 of the sprayer comprising a spray head 122, wherein the sprayer 114 is detachably attached to the bracket 112 and the sprayer 114 is hold in a desired position by the bracket 114 and the one or more stoppers 107 on the panel 104 in a snap fit relationship, the body 116 of the sprayer 114 further comprising a pressure actuated and spring biased spray trigger 132, whereby intensity of the discharged cleaning fluid 202 is adjustable to facilitate targeted cleaning of the bottom of the footwear sole 200; and a stepper 123 pivotally joined to the panel 104 at a hinge 130, wherein the stepper 123 comprising a foot platform 126, a foot trigger 124 extending away from the foot platform 126, a cylindrical side wall 125 and one or more legs 128 extended from the side wall 125, the foot platform 126 comprises an annular surface 129 and a central hollow area 127 configured to expose the spray head 122 towards a footwear sole 200 of a user placed on the annular surface 129 of the foot platform 126, further the central hollow area 127 and the cylindrical side wall 125 are configured to control the cleaning fluid 202 and debris within a cleaning area defined by the central hollow area 127 and the cylindrical side wall 125, the one or more legs 128 of the stepper 123 engage with the elongated body 116 of the sprayer 114, thereby allowing the foot trigger 124 to remain in a desired position over the spray trigger 122 external to the cylindrical wall 125 of the stepper 123, whereby pressing the foot trigger 124 by the footwear sole 200 presses the spray trigger 122 for actuating discharge of the cleaning fluid 202 from the spray head 122 through the central hollow area 127 of the foot platform 126 to provide a hands-free cleaning of the sole of the footwear 200 and dislodge the discharged cleaning fluid 202 and debris from the footwear sole 200 to flow freely within the central hollow area 127 of the cylindrical wall 125 of the stepper 123 and beneath the elevated base 102 through the multiple apertures 108 in the elevated base 102, thereby prevent splashing of the cleaning fluid 202 and the debris, wherein the one or more legs 128 of the cylindrical side wall 125 rest on the panel 104 when the foot trigger 124 is fully pressed, thereby preventing excess pressure on the spray trigger 122.

In another aspect, a rubber grip (not shown) is disposed at the bottom of each mount member 110 to prevent slippage across the ground surface.

In another aspect, the annular surface 129 is sloped towards the spray head 122 such that the discharged cleaning fluid 202 and debris from the footwear sole 200 flow freely within the cylindrical wall 125 of the stepper 123 and beneath the elevated base 102.

In another aspect, the cleaning fluid 202 is selected from the group consisting of water, water and soap solution, alcohol, air or a combination thereof.

In another aspect, the annular surface 129 of the foot platform 126 comprises a textured surface.

In another aspect, the sprayer 114 is configured to be detached from the device 100 and can be used by pressing the spray trigger 132 by user's hand thereby facilitating independent use of the sprayer 132 other than the hands-free footwear sole cleaning application.

In another aspect, the cylindrical side wall 125 of the stepper 123 and the central hollow area 127 of the foot platform 126 prevent the cleaning fluid 202 and debris from contacting the spray trigger 132 of the device 100 and prevents splashing the cleaning fluid 202 towards the user's clothing or upper part of the footwear or the spray trigger 132 of the device 100.

In another aspect, the elevated base 102 is fabricated from material that is selected from the group consisting of a polymer, a lightweight metal, a metal alloy, rubber, wood, ceramic, fiberglass and combinations thereof.

In another aspect, the body 116 of the sprayer 114 is fabricated from a rust proof material.

In another aspect, the annular configuration of the foot platform 126 of the stepper 123 is toilet seat shaped.

In another aspect, the intensity of the discharged cleaning fluid 202 is directly proportional to the amount of foot pressure applied on the spray trigger 132, thereby facilitating targeted cleaning of the bottom of the footwear sole 200.

The present invention allows the user to clean the bottom of the footwear sole 200 by enabling hands-free actuation of a sprayer 114 to spray cleaning fluid 202 towards the footwear sole 200 at adjustable intensities; so as to discharge a cleaning fluid 202 directly into the crevices and traction that form in the bottom of the footwear sole 200.

Figure 12A:
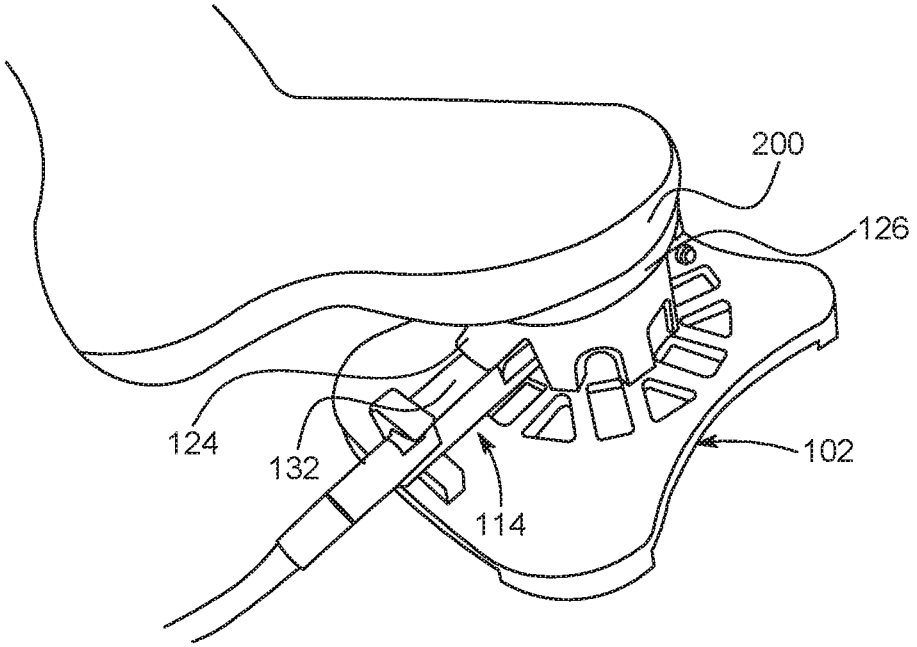
FIGS. 12A and 12B illustrate perspective views of different positions a footwear soles is being placed on the foot platform of the hands-free footwear sole cleaning device to clean the bottom of the footwear sole, in accordance with an embodiment of the present invention.
Figure 12B:
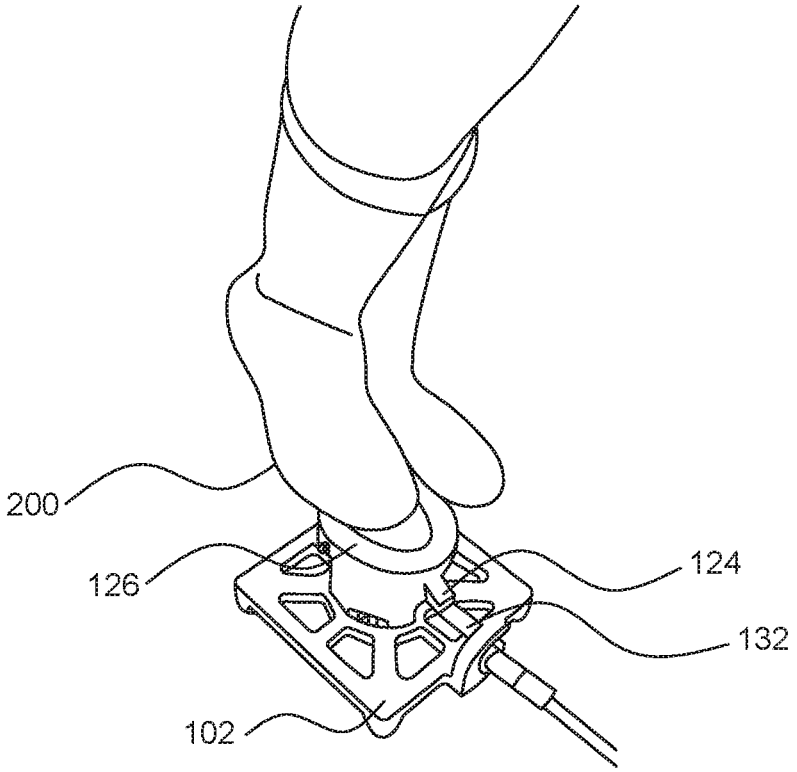

As referenced in FIG. 1, the device 100 comprises an elevated base 102 that provides support and, through its elevated position enables drainage of the cleaning fluid and debris from the footwear sole 200. The device 100 also includes a sprayer 114 that is detachably retained in the elevated base 102 to carry a cleaning fluid 202 towards discharge. The sprayer 114 is disposed upwardly, away from the base 102 and positioned targeting towards the footwear sole 200 for cleaning of the crevices and traction at the bottom of the footwear sole 200 (FIG. 12A-B). The device 100 includes a stepper 123 that is pivotally moved to a desired position such that a foot trigger 124 of the stepper 123 is in communication with a spray trigger 132 of the sprayer 114. By depressing the foot trigger 124 with the footwear sole 200, the sprayer 114 is actuated to discharge cleaning fluid 202 towards the footwear sole 200 with minimal splashing and debris dislodgement above the elevated base 102.

As shown in at least FIGS. 1, 3, 4, 6 and 7, the elevated base 102 of the device 100 provides support to the entire device 100 in a raised position. The elevated disposition allows cleaning fluid 202 and debris to flow within a cylindrical side wall 125 of the stepper 123 and beneath the device 100 with minimized splashing and away from the spray trigger 122, the user and the footwear sole 200. In some embodiments, the elevated base 102 comprises a panel 104 that is defined by a bottom surface 105, a top surface 106, and multiple apertures 108 that form in a spaced apart relationship through the panel 104. The bottom surface 105 is oriented towards a ground surface, while the top surface 106 is oriented upwardly towards the footwear sole. The bottom view of the device 100 showing the bottom view of the elevated base 102 in FIG. 5. The elevated base 102 further comprises at least one mount member 110 that extends from the bottom surface 105 of the panel 104. The mount member 110 elevates the base 102 above the ground surface. In one embodiment, the at least one mount member 110 comprises one or more wide feet. A rubber grip (not shown) may be disposed at the bottom of each foot 110 to help inhibit slippage across the ground surface.

Figure 2:
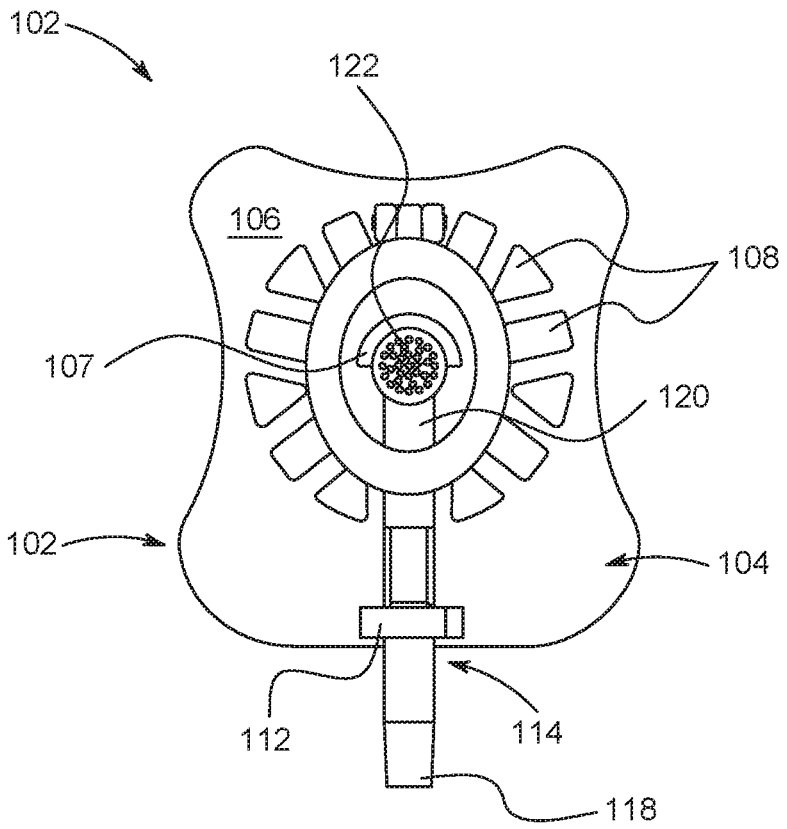
FIG. 2 illustrates a top view of the hands-free footwear sole cleaning device shown in FIG. 1 with the foot trigger engaged with a spray trigger, in accordance with an embodiment of the present invention.
Figure 4:
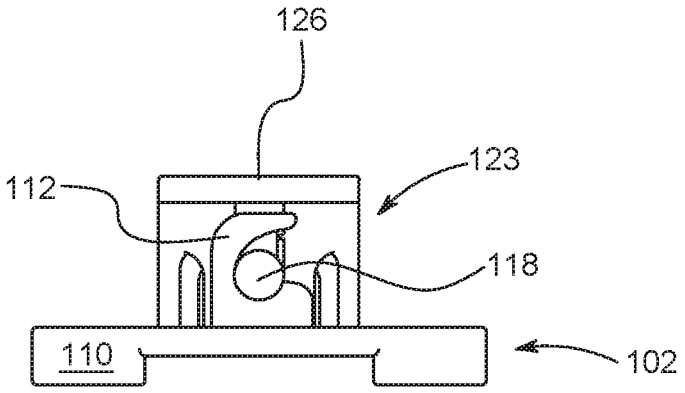
FIG. 4 illustrates a front view of the hands-free footwear sole cleaning device shown in FIG. 1 with the foot trigger engaged with a spray trigger, in accordance with an embodiment of the present invention.

In another embodiment as shown in at least FIGS. 1-2, the sprayer 114 comprises an elongated hollow body 116 for carrying the cleaning fluid 202 from a source (not shown) through an inlet end 118 to a discharge end 120. Further the discharge end 120 of the sprayer 114 comprising a spray head 122, wherein the sprayer 114 is detachably attached to the bracket 112 and the sprayer 114 is hold in a desired position by the bracket 112 on the elevated base 102 in a snap fit relationship as shown in FIG. 4.

Figure 3:
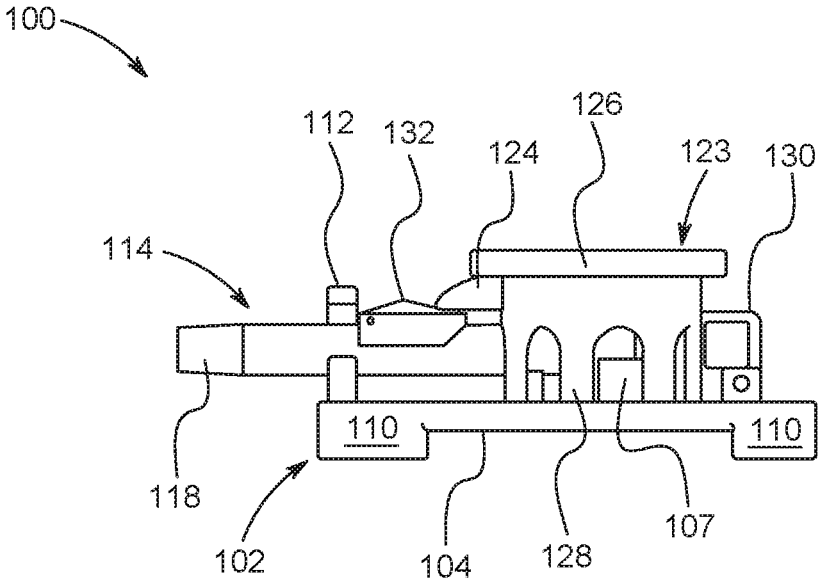
FIG. 3 illustrates a side view of the hands-free footwear sole cleaning device shown in FIG. 1 with the foot trigger engaged with a spray trigger, in accordance with an embodiment of the present invention.

The body 116 of the sprayer 114 further comprising a pressure actuated and spring biased spray trigger 132 (FIG. 3). Further intensity of the discharged cleaning fluid 202 is also adjustable to facilitate targeted cleaning of the bottom of the footwear sole 200. In one exemplary embodiment, the intensity of the discharged cleaning fluid is directly proportional to the amount of foot pressure applied on the spray trigger, thus the user can control the intensity of the discharged cleaning fluid as per the requirement of the user by applying desired pressure on the spray trigger 132.

Figure 6:
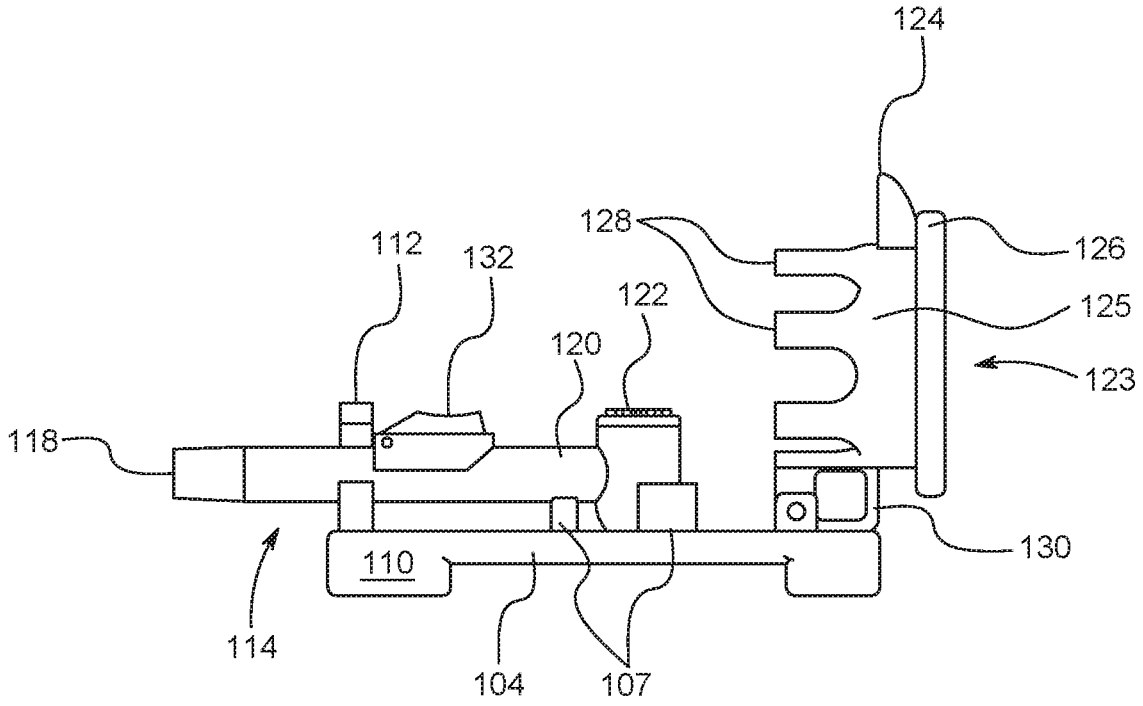
FIG. 6 illustrates a side view of the hands-free footwear sole cleaning device shown in FIG. 1 with a stepper pivoted away from the spray trigger, in accordance with an embodiment of the present invention.
Figure 7:
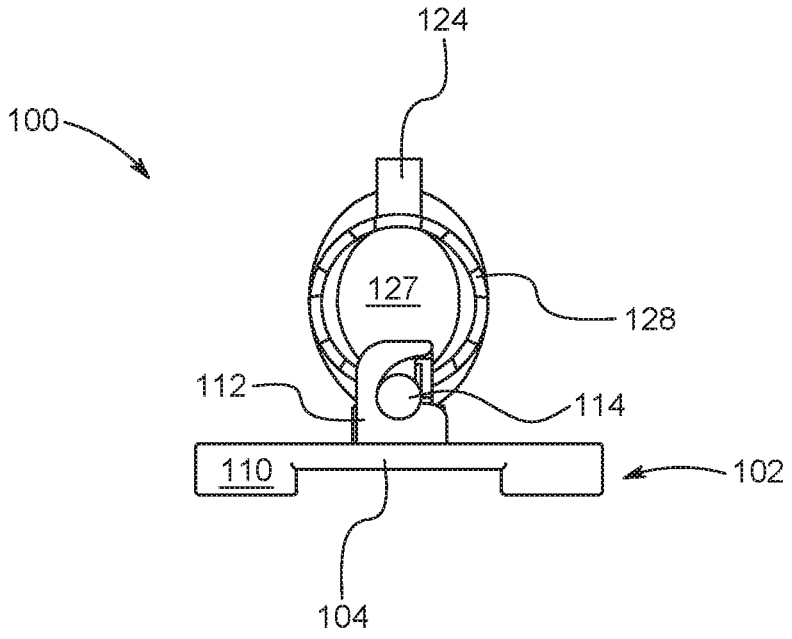
FIG. 7 illustrates a front view of the hands-free footwear sole cleaning device shown in FIG. 1 with the stepper pivoted away from the spray trigger, in accordance with an embodiment of the present invention.
Figure 8:
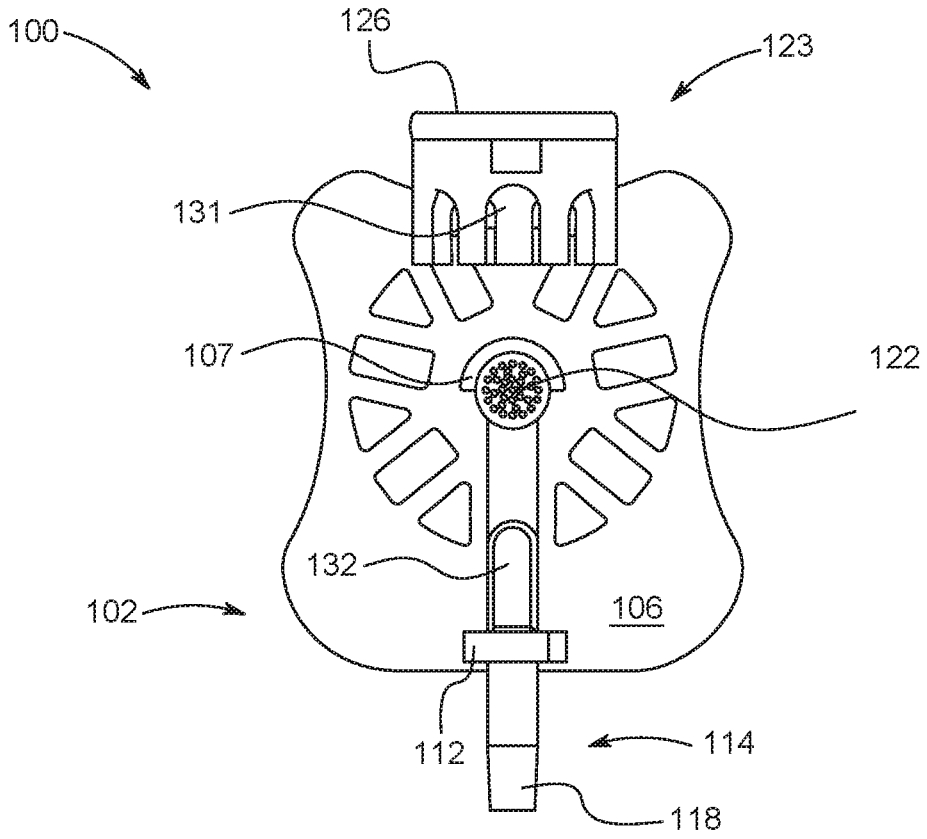
FIG. 8 illustrates a top view of the hands-free footwear sole cleaning device shown in FIG. 1 with the stepper pivoted away from the spray trigger, in accordance with an embodiment of the present invention.

Further at least the FIGS. 6, 7, and 8 illustrate the stepper 123 that is pivotally attached to the panel 104 of the elevated base 102. FIG. 6 shows the side view of the device 100, FIG. 7 shows the top view of the device 100 and the FIG. 8 shows the front view of the device 100 illustrating the stepper 123 in open (non-operational) position when the device 100 is not in use. The stepper 123 pivotally joins the panel 104 of the elevated base 102 at a hinge 130. The stepper 123 may join the panel 104 at one end, hinging away from the sprayer 114 when the device is in the open position. The stepper 123 may join the panel 104 at one end, hinging away from the sprayer 114. The stepper 123 comprising a foot platform 126, a foot trigger 124, a cylindrical side wall 125 and one or more legs 128 extended from the side wall 125.

Figure 5:
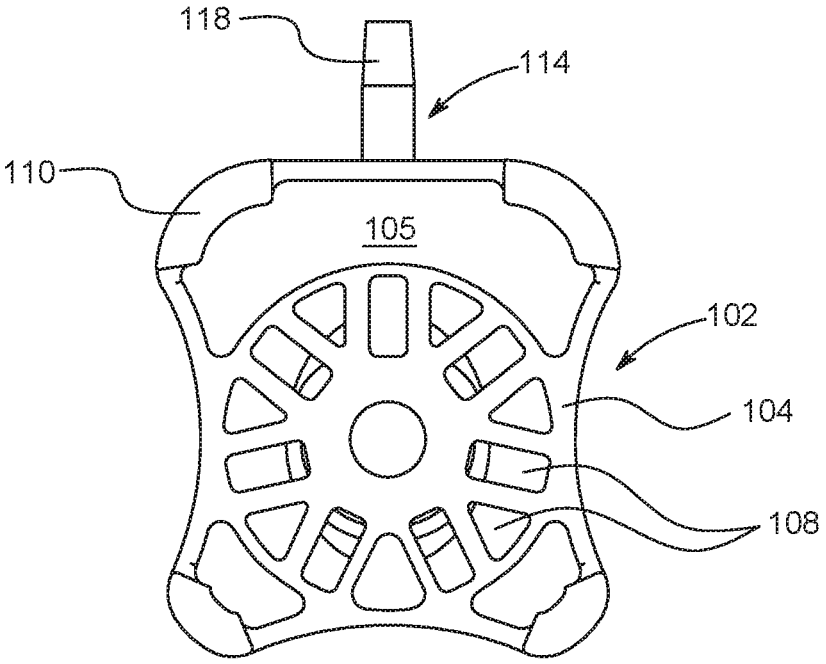
FIG. 5 illustrates a bottom view of the hands-free footwear sole cleaning device shown in FIG. 1, in accordance with an embodiment of the present invention.

The foot platform 126 comprises an annular surface 129 and a central hollow area 127 configured to expose the spray head 122 towards the footwear sole 200 of the user, wherein the footwear sole 200 is placed on the annular surface 129 of the foot platform 126 as shown in the top view of the device 100 in the FIG. 2. However, FIG. 3 shows a side view of the device 100 and FIG. 5 shows a bottom view of the device 100 illustrating, a slot 131 between two consecutive legs 128 of the stepper 123 engage with the elongated body 116 of the sprayer 114, thereby allowing the foot trigger 124 to remain in a desired position over the spray trigger 132. The foot trigger 124 and the spray trigger 132 are positioned external to the cylindrical wall 116 of the stepper 123, thereby preventing splashing of the dirty cleaning fluid and the debris after washing the footwear sole on the spray trigger, so as to prevent malfunction of the spray trigger because of debris blocking the smooth functioning of the spray trigger 132.

As shown in FIG. 6, the elevated base 102 further comprises one or more stoppers 107 on the panel 104. The stoppers 107 along with the bracket 112 disposed at the top surface 106 of the panel 104 of the elevated base 102, enables a discharge and the sprayer 114 to be retained securely in a desired position for targeted cleaning of the footwear sole 200. In one embodiment, the sprayer 114 is detachably attached to the bracket 112 and the sprayer 114 is hold in a desired position by the bracket 112 and the one or more stoppers 107 on the panel 104 in a snap fit relationship. Though other connectivity means may be used to detachably attach the spray head 122 to the elevated base 102. Further according to an exemplary embodiment, the elevated base 102 has a generally square shape; however other shape and design of the elevated base 102 can be used without departing from the scope and spirit of the present invention. Suitable materials for the elevated base 102 may include, without limitation, a polymer, lightweight metal, a metal alloy, rubber, wood, and fiberglass.

Those skilled in the art will recognize that the cleaning fluid 202 for removing debris from the footwear sole 200 can include water, water and soap solution, alcohol, air or combinations thereof. Other cleaning fluids 202 may, however, also be used in further embodiments including warm or hot solutions.

Figure 9:
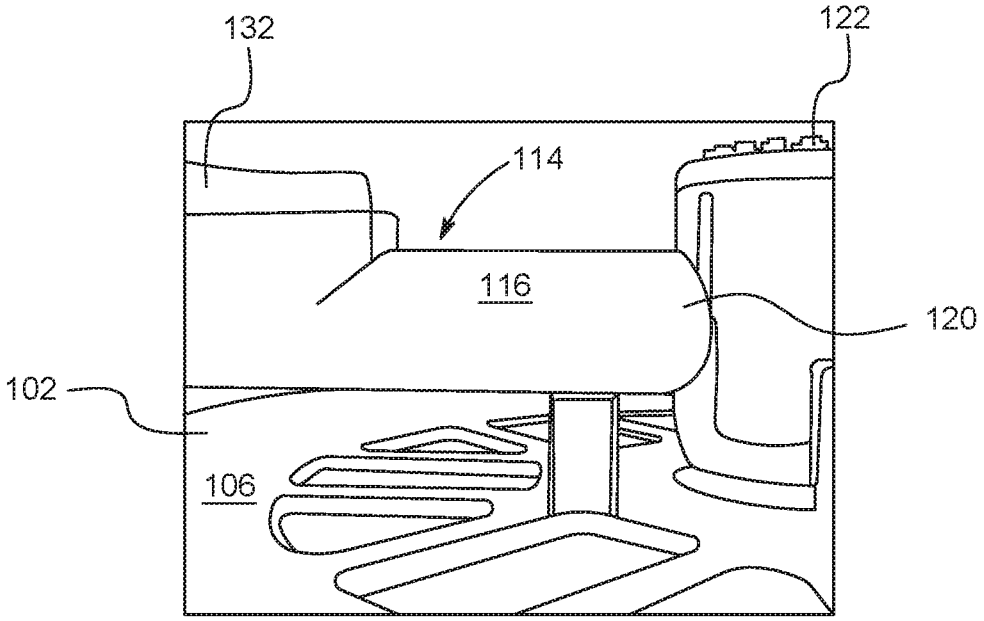
FIG. 9 illustrates a close up side view of a sprayer of the hands-free footwear sole cleaning device shown in FIG. 1, in accordance with an embodiment of the present invention.
Figure 10:
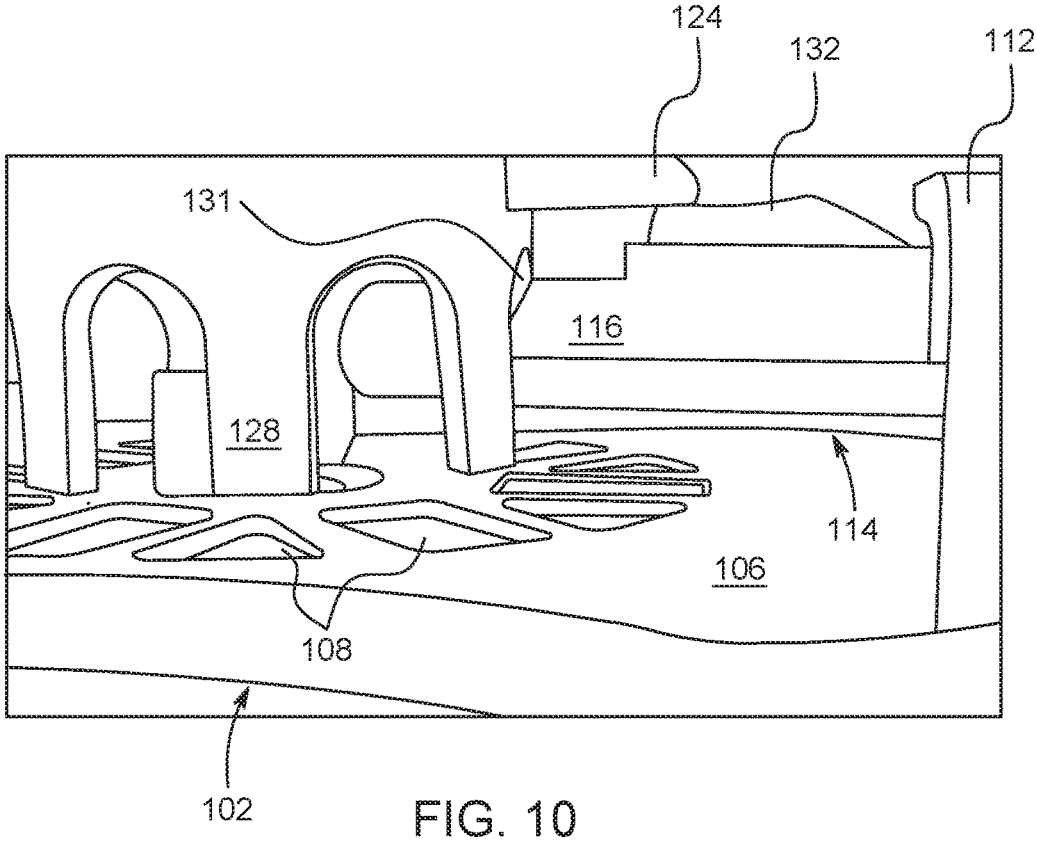
FIG. 10 illustrates a close up side view of the foot trigger engaging the spray trigger of a sprayer of the hands-free footwear sole cleaning device, in accordance with an embodiment of the present invention.

As FIG. 9 and FIG. 10 illustrates close-up view of the elongated hollow body 116 of the sprayer 114. The body 116 may include a stainless steel composition that inhibits rusting, however other rust proof materials can be utilized without departing from the scope and spirit of the present invention. FIG. 9 illustrates open (non-operational) position of the stepper (not shown) when the device 100 is not in use; thereby showing only the spray trigger 132 on the elongated hollow body 116 of the sprayer 114. FIG. 10 illustrates closed (operational) position of the stepper 123 when the device 100 is in use however; thereby showing the foot trigger 124 in a desired position over the spray trigger 132. In one exemplary embodiment, the spray trigger 132 is spring biased. In this manner, pressing the foot trigger 124 by the footwear sole 200 presses the spray trigger 132 for actuating discharge of the cleaning fluid from the spray head 122 through the central hollow area 127 of the foot platform 126 to provide a hands-free cleaning of the sole of the footwear 200.

Figure 11:
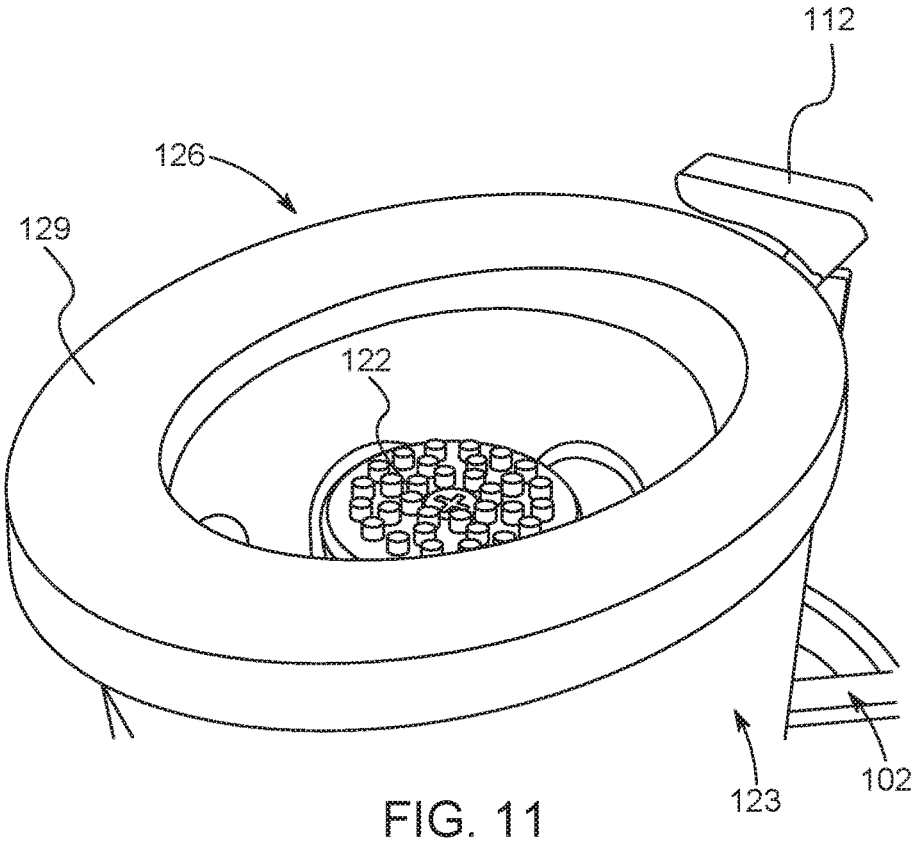
FIG. 11 illustrates a close up perspective view of a foot platform and a spray head of the hands-free footwear sole cleaning device, in accordance with an embodiment of the present invention.

In one non-limiting embodiment as shown in FIG. 1 and FIG. 11, the foot platform 126 of the stepper 123 comprises an annular surface 129. The annular foot platform 126 comprises a central hollow area 127 configured to expose the spray head 122 towards a footwear sole 200 of a user, the footwear sole 200 is placed on the annular surface 129 of the foot platform 126 allowing the pressurized stream of cleaning fluid 202 from the spray head 122 to thoroughly clean crevices and traction on the bottom of the footwear sole 200 without using the hands. The foot platform 126 more specifically has a doughnut shape that is sized and dimensioned to receive a region of the bottom of the footwear sole 200. This annular shape allows for a more targeted cleaning of the bottom of the footwear sole 200 while preventing splashing of the cleaning fluid 202. Other shapes of the foot platform 126 including a square shape, a rectangular shape, and a pyramid shape can be used without departing from the scope and spirit of the present invention however. The foot platform 126 may be textured or fabricated from rubber or other flexible material, so as to help inhibit slippage of the footwear sole 200 while pressing down on the foot platform 126.

As shown in FIG. 12A-B and FIG. 1, the legs 128 that extend from the cylindrical side wall 125 of the stepper 123 are configured to be positioned on the panel 104 of the elevated base 102 while the stepper 123 is maintained in a position by aligning a slot 131 of the cylindrical side wall 125 with the elongated body 116 of the sprayer, wherein the slot 131 may be the gap between two consecutive legs 128 extended from the cylindrical side wall thereby allowing he foot trigger 124 to remain in a desired position over the spray trigger 132. The legs 128 rest on panel 104 of the elevated base 102 to provide support for the stepper 123 when the user places the footwear on the foot platform 126 of the stepper 123, while the foot trigger 124 engages the spray trigger 132. This allows the foot trigger 124 to fully press down onto the spray trigger 132 for actuating discharge of the cleaning fluid 202 from the spray head 122 through the central hollow area 127 of the foot platform 126 to provide a hands-free cleaning of the footwear sole 200. The cylindrical side wall 125 of the stepper 123 directs the cleaning fluid 202 to flow within the central hollow area 127 of the foot platform 126 and prevents splashing the cleaning fluid 202 other than the footwear sole 200. After cleaning the sole of the first footwear, the user can then place the second footwear on the device 100 and clean the sole of the second footwear in the same manner.

In an exemplary embodiment as shown in FIGS. 1, 10 and 12A, the one or more legs 128 of the cylindrical side wall 125 rest on the panel 104 when the foot trigger 124 is fully pressed, thereby preventing excess pressure on the spray trigger 122.

In another exemplary embodiment, the foot trigger 124 or cylindrical wall 125 can be made of flexible material, thereby allowing the foot trigger to be pressed to bend the foot trigger 124 to a desired angle to press the spray trigger to a desire position as per the flow intensity of the cleaning fluid 202 desired by applying the subsequent amount of foot pressure by the user on the foot trigger 124. Further, any such modification to the design for controlling the pressure on the spray trigger 122 can be achieved without departing from the scope and spirit of the present invention.

In an exemplary embodiment, the annular surface 129 is sloped towards the spray head 122 such that the discharged cleaning fluid 202 and debris from the footwear sole 200 flow freely within the cylindrical wall 125 of the stepper 123 and beneath the elevated base 102 as shown in FIGS. 1, 2, and 11, so as to facilitate a user to place the shoe in a desired position while cleaning the footwear sole 200 by the discharged cleaning fluid 202 and allowing the discharged cleaning fluid 202 and debris from the footwear sole 200 to flow freely within the central hollow area 127 of the cylindrical side wall 125 of the stepper 123 and beneath the elevated base 102 through the multiple apertures 108 in the elevated base 102, thereby preventing splashing of the cleaning fluid 202 and the debris (FIG. 12A). The user can press down with different sections of the footwear sole 200 to clean the respective section of the footwear sole 200 while pressing the foot trigger 124 by pressing the foot platform 126 from any suitable direction (FIG. 12B). And as discussed above, intensity of the cleaning fluid 202 can be adjusted to accommodate different cleaning needs and footwear sole types.

Figure 13A:
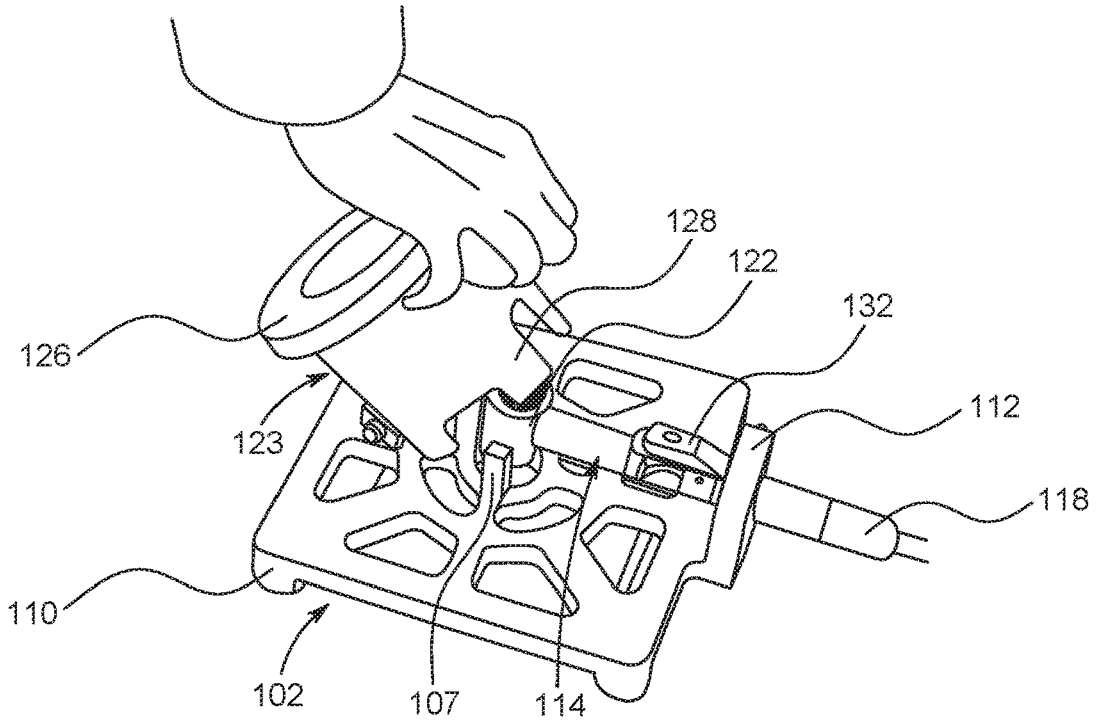
FIGS. 13A and 13B illustrate perspective views of the device self-cleaning, where
Figure 13B:
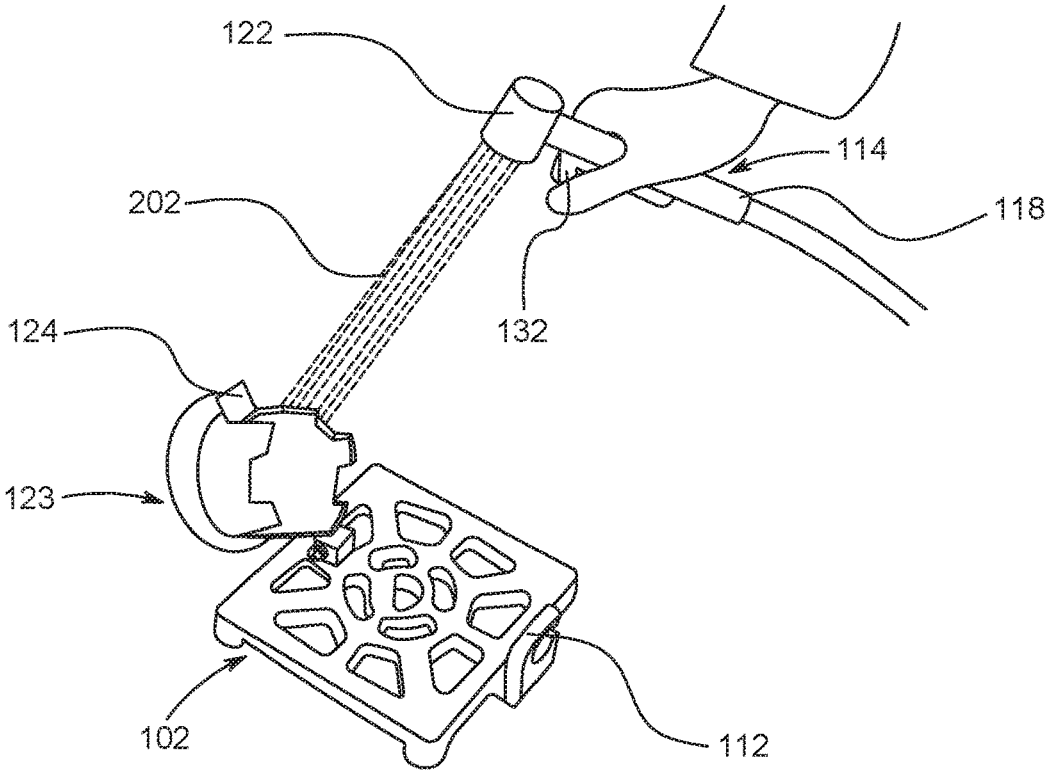

FIGS. 13A and 13B illustrate perspective views of the device 100 showing that the sprayer 114 of the device 100 can be used to clean the device itself. This self-cleaning feature is possible because the spray head 122 detaches from the bracket 112 on the base 102. FIG. 13A shows the foot trigger 124 being pivotally displaced away from the base 102, which also serves to move the device 100 to an open (non-operational) position. FIG. 13B shows the sprayer 114 detached from the base 102 and spraying the cleaning fluid 202 on to the stepper 123 and the base 102. In this manner, debris from the footwear sole 200 is removed from the base 102 and the stepper 123. The cleaning fluid 202 flows beneath the elevated base 102 during self-cleaning, as in cleaning the footwear sole 200. It is significant to note that when the sprayer 114 is detached from the base 102, the spray trigger 132 is depressed with the hands of the user for cleaning the device 100. Further the sprayer 114 can be used for other cleaning purposes such as watering plants and the like. The device 100 is portable by allowing the stepper 123, the base 102 and the sprayer 114 dissembled to be carried separately for easy and quick transportation to a golf court, construction site or the like as per the user's requirement.

Figure 14:
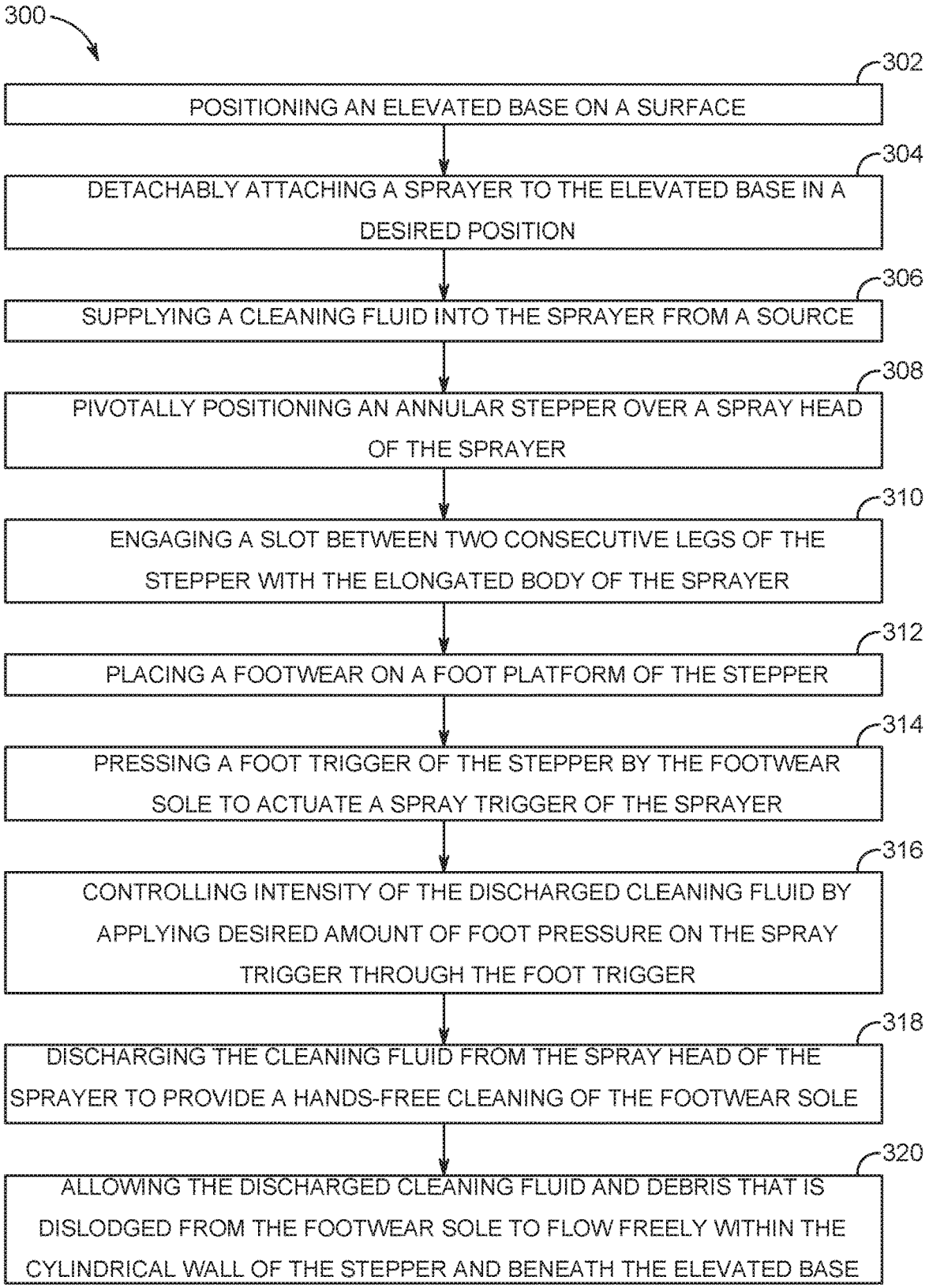
FIG. 14 illustrates a flowchart diagram of an exemplary method for hands-free cleaning of a footwear sole, in accordance with an embodiment of the present invention.

FIG. 14 illustrates a flowchart diagram of an exemplary method 300 for hands-free cleaning of a footwear sole. The method 300 may include an initial Step 302 of positioning an elevated base on a ground surface. The method 300 may further comprise a Step 304 of detachably attaching a sprayer to the elevated base and holding the sprayer is in a desired position by the bracket and one or more stoppers on the base in a snap fit relationship, wherein the sprayer defined by an elongated hollow body for carrying a cleaning fluid, an inlet end for receiving the cleaning fluid, and a discharge end for discharging the cleaning fluid, the discharge end of the sprayer comprising a spray head, the body of the sprayer further comprising a pressure actuated and spring biased spray trigger for actuating discharge of the cleaning fluid. A Step 306 includes supplying the cleaning fluid into the body of the sprayer from a source.

In some embodiments, a Step 308 comprises pivotally positioning a stepper over the spray head by a footwear sole of a user, wherein the stepper is joined to the base at a hinge, further the stepper comprising a foot platform, a foot trigger, a cylindrical side wall and one or more legs extended from the side wall, the foot platform comprises an annular surface and a central hollow area. A Step 310 includes engaging a slot between two consecutive legs of the stepper with the elongated body of the sprayer, thereby allowing the foot trigger to remain in a desired position over the spray trigger, a Step 312 may include placing the footwear sole of the user on the annular surface of the foot platform of the stepper, whereby the central hollow area of the foot platform is configured to expose the spray head towards the footwear sole of the user. A Step 314 may include pressing the foot trigger by the footwear sole to press the spray trigger. A Step 316 comprises controlling the intensity of the discharged cleaning fluid, wherein the intensity of the discharged cleaning fluid is directly proportional to the amount of foot pressure applied on the spray trigger through the foot trigger, wherein the one or more legs of the cylindrical side wall rest on the elevated base when the foot trigger is fully pressed, thereby preventing excess pressure on the spray trigger. A Step 318 may include discharging the cleaning fluid from the spray head through the central hollow area of the foot platform to provide a hands-free cleaning of the sole of the footwear. A final Step 320 comprises allowing the discharged cleaning fluid and debris that is dislodged from the footwear sole to flow freely within the cylindrical wall of the stepper and beneath the elevated base through the multiple apertures in the elevated base, thereby prevent splashing of the cleaning fluid and the debris.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A hands-free footwear sole cleaning device, the device comprising:

an elevated base comprising multiple apertures;

a bracket attached to the elevated base;

a sprayer detachably attached to the bracket, wherein the sprayer comprises an elongated hollow body for carrying a cleaning fluid from a source through an inlet end to a discharge end, the discharge end of the sprayer comprising a spray head, the body of the sprayer further comprising a pressure actuated spray trigger; and a stepper pivotally joined to the elevated base, wherein the stepper comprises a foot platform, a cylindrical wall, and a foot trigger extending away from the foot platform, the foot platform comprises an annular surface that is configured to expose the spray head towards a footwear sole of a user placed on the annular surface, the cylindrical wall comprises at least one slot to engage with the elongated body of the sprayer, thereby allowing the foot trigger to remain in a desired position over the spray trigger external to the cylindrical wall of the stepper, whereby applying pressure on the foot trigger by the footwear sole presses the spray trigger for actuating discharge of the cleaning fluid through the spray head thereby providing a hands-free cleaning of the sole of the footwear and dislodging the discharged cleaning fluid and debris from the footwear sole to flow freely within the cylindrical wall of the stepper and beneath the elevated base through the multiple apertures in the elevated base, thereby preventing splashing of the cleaning fluid and the debris.

2. The device of claim 1, wherein intensity of the discharged cleaning fluid is directly proportional to the amount of foot pressure applied on the spray trigger, thereby facilitating targeted cleaning of the bottom of the footwear sole.

3. The device of claim 1, wherein the annular foot platform comprises a central hollow area configured to expose the spray head towards a footwear sole of a user, the footwear sole is placed on the annular surface of the foot platform allowing the pressurized stream of cleaning fluid from the spray head to thoroughly clean crevices and traction on the bottom of the footwear sole without using the hands.

4. The device of claim 1, wherein the cleaning fluid is selected from the group consisting of water, water and soap solution, alcohol, air or a combination thereof.

5. The device of claim 1, wherein the bracket is configured to receive the spray head in a snap fit relationship.

6. The device of claim 1, wherein the spray trigger is spring biased.

7. The device of claim 1, wherein the sprayer is configured to be detached from the device and operated by pressing the spray trigger thereby facilitating independent use of the sprayer.

8. A hands-free footwear sole cleaning device, the device comprising:

an elevated base comprising a panel defined by a top surface, a bottom surface and multiple apertures formed in a spaced apart relationship through the panel, the base further comprising at least one mount member extending from the bottom surface of the panel to elevate the panel above the ground surface to a desired height;

one or more stoppers attached to the top surface of the panel;

a bracket attached to the bottom surface of the panel;

a sprayer comprising an elongated hollow body for carrying a cleaning fluid from a source through an inlet end to a discharge end, the discharge end of the sprayer comprising a spray head, wherein the sprayer is detachably attached to the bracket and the sprayer is hold in a desired position by the bracket and the one or more stoppers on the panel in a snap fit relationship, the body of the sprayer further comprising a pressure actuated and spring biased spray trigger, whereby intensity of the discharged cleaning fluid is adjustable to facilitate targeted cleaning of the bottom of the footwear sole; and a stepper pivotally joined to the panel at a hinge, wherein the stepper comprises a foot platform, a foot trigger extending away from the foot platform, a cylindrical side wall and one or more legs extended from the side wall, the foot platform comprises an annular surface and a central hollow area configured to expose the spray head towards a footwear sole of a user placed on the annular surface of the foot platform, the one or more legs of the stepper engage with the elongated body of the sprayer, thereby allowing the foot trigger to remain in a desired position over the spray trigger external to the cylindrical wall of the stepper, whereby pressing the foot trigger by the footwear sole presses the spray trigger for actuating discharge of the cleaning fluid from the spray head through the central hollow area of the foot platform to provide a hands-free cleaning of the sole of the footwear and dislodge the discharged cleaning fluid and debris from the footwear sole to flow freely within the central hollow area of the cylindrical side wall of the stepper and beneath the elevated base through the multiple apertures in the elevated base, thereby prevent splashing of the cleaning fluid and the debris, wherein the one or more legs of the cylindrical side wall rest on the panel when the foot trigger is fully pressed, thereby preventing excess pressure on the spray trigger.

9. The device of claim 8, wherein the annular surface is sloped towards the spray head such that the discharged cleaning fluid and debris from the footwear sole flow freely within the cylindrical wall of the stepper and beneath the elevated base.

10. The device of claim 8, wherein a rubber grip is disposed at the bottom of each mount member to prevent slippage across the ground surface.

11. The device of claim 8, wherein the cleaning fluid is selected from the group consisting of water, water and soap solution, alcohol, air or a combination thereof.

12. The device of claim 8, wherein the sprayer is configured to be detached from the device and can be used by pressing the spray trigger by user's hand thereby facilitating independent use of the sprayer other than the hands-free footwear sole cleaning.

13. The device of claim 8, wherein the cylindrical side wall of the stepper and the central hollow area of the foot platform prevent the cleaning fluid and debris to contact the spray trigger and prevents splashing of the cleaning fluid other than on the footwear sole.

14. The device of claim 8, wherein the elevated base is fabricated from material that is selected from the group consisting of a polymer, a lightweight metal, a metal alloy, rubber, wood, ceramic, fiberglass and combination thereof.

15. The device of claim 8, wherein the annular configuration of the foot platform of the stepper is toilet seat shaped.

16. The device of claim 1, wherein intensity of the discharged cleaning fluid is directly proportional to the amount of foot pressure applied on the spray trigger, thereby facilitating targeted cleaning of the bottom of the footwear sole.

* * * * *